US006087592A

United States Patent [19]

Nagel et al.

[11] Patent Number: 6,087,592

[45] **Date of Patent: *Jul. 11, 2000**

[54] ENAMELED WIRE WITH HIGH RESISTANCE TO PARTIAL DISCHARGES

[75] Inventors: Rolf Nagel, Bramsche, Germany; Virginie Studer, Chassieu, France; Laurent Preux, Chozeau, France; Léonard Danel, Neuflieux, France

[73] Assignee: Alcatel, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/028,810

[22] Filed: Feb. 24, 1998

[30] Foreign Application Priority Data

Feb. 24, 1997 [FR] France ..... 97 02166

[51] Int. Cl.[7] ..... H01B 7/00

[52] U.S. Cl. ..... 174/120 R; 310/179; 428/383

[58] Field of Search ..... 174/120 R, 120 SR, 174/120 SC, 105 SC; 310/179; 428/383, 372

[56] References Cited

U.S. PATENT DOCUMENTS

| | | | |
|---|---|---|---|
| 3,493,413 | 2/1970 | Olson et al. | 174/120 R X |
| 3,787,255 | 1/1974 | Carini et al. | 174/120 R X |
| 4,008,368 | 2/1977 | Leuchs | 174/120 R |
| 4,075,421 | 2/1978 | McCullough | 174/120 R X |
| 4,388,371 | 6/1983 | Bolon et al. | 428/383 |
| 4,537,804 | 8/1985 | Keane et al. | 174/120 R X |
| 4,760,296 | 7/1988 | Johnston et al. | 310/45 |
| 5,654,095 | 8/1997 | Yin et al. | 174/120 R X |
| 5,861,578 | 1/1999 | Hake et al. | 174/120 R |

FOREIGN PATENT DOCUMENTS

| | | |
|---|---|---|
| 0287813A2 | 10/1988 | European Pat. Off. . |
| 0447789A1 | 9/1991 | European Pat. Off. . |
| 0568415A1 | 11/1993 | European Pat. Off. . |

*Primary Examiner*—Dean A. Reichard
*Assistant Examiner*—Chau N. Nguyen
*Attorney, Agent, or Firm*—Sughrue, Mion, Zinn, Macpeak & Seas, PLLC

[57] ABSTRACT

An enameled wire having high resistance to partial discharges includes an electrical conductor and at least two layers of enamel on the conductor. At least one of these layers is made from resin charged with weakly conductive particles. The outermost layer constitutes an overcoat and is made from thermo-adherent resin. At least the layer directly underlying the overcoat is made from the resin charged with the particles.

7 Claims, 2 Drawing Sheets

ENAMELED WIRE WITH HIGH RESISTANCE TO PARTIAL DISCHARGES

BACKGROUND OF THE INVENTION

1. Field of the invention

The present invention concerns enameled wire with high resistance to partial discharges.

2. Description of the prior art

Insulating electrical wires with enamel provides a thin insulation on electrical wires. It can become insufficient for some applications. This is the case when such wires are used for the windings of alternating current motors, for example. Such motors are controlled by frequency converters that operate at higher and higher frequencies which can lead to premature aging of the enameled wires of the windings. Such aging is due in particular to partial discharges in the windings.

Document U.S. Pat. No. 4,537,804 describes a corona-resistant enameled wire which includes an electrical conductor and two layers of enamel on the latter. The two enamel layers are made from different resins. The resin of at least one of the two enamel layers contains very fine particles of alumina dispersed in the resin.

Charging an enameling resin with weakly conductive particles selected from metal oxides and organo-metallic compounds to improve the corona-resistance of the resin is known in itself.

Making a winding with contiguous turns using a wire insulated in the above manner necessarily requires that at least the outermost enamel layer be the one charged with weakly conductive particles to assure peripheral continuity of the exterior layers of the various turns and to distribute the electrical field across all of the turns.

An enameled wire of the above kind is flexible but less so than an enameled wire in which the resin of the enamel layers is not charged with such particles. It also has a smooth surface, but less so than the surface of a wire with an exterior enamel layer that is not charged. As a result winding an enameled wire of the above kind is more difficult and the performance obtained after winding is often not so good as was hoped for.

An aim of the present invention is to avoid the above problems.

SUMMARY OF THE INVENTION

The present invention consists in an enameled wire having high resistance to partial discharges including an electrical conductor and at least two layers of enamel on said conductor wherein at least one layer is made from resin charged with weakly conductive particles, an outermost layer constitutes an overcoat and is made from thermo-adherent resin and at least the layer directly underlying the overcoat is made from the resin charged with the particles.

During winding of the above enameled wire and a subsequent fusion phase with the turns pressed together the layers of resin charged with particles of the various turns come into contact with each other to assure that the particles that they contain come into contact. At the same time the thermo-adherent resin of the overcoat fills any air gaps that could otherwise be filled with air and generate partial discharges. The result is a homogeneous distribution of the electrical field across all the turns of the winding.

The features and advantages of the present invention will emerge from the following description of one embodiment shown in the appended drawings by way of non-limiting preferred example.

DETAILED DESCRIPTION OF THE PREFERRED EMBODIMENT

Figure 1:
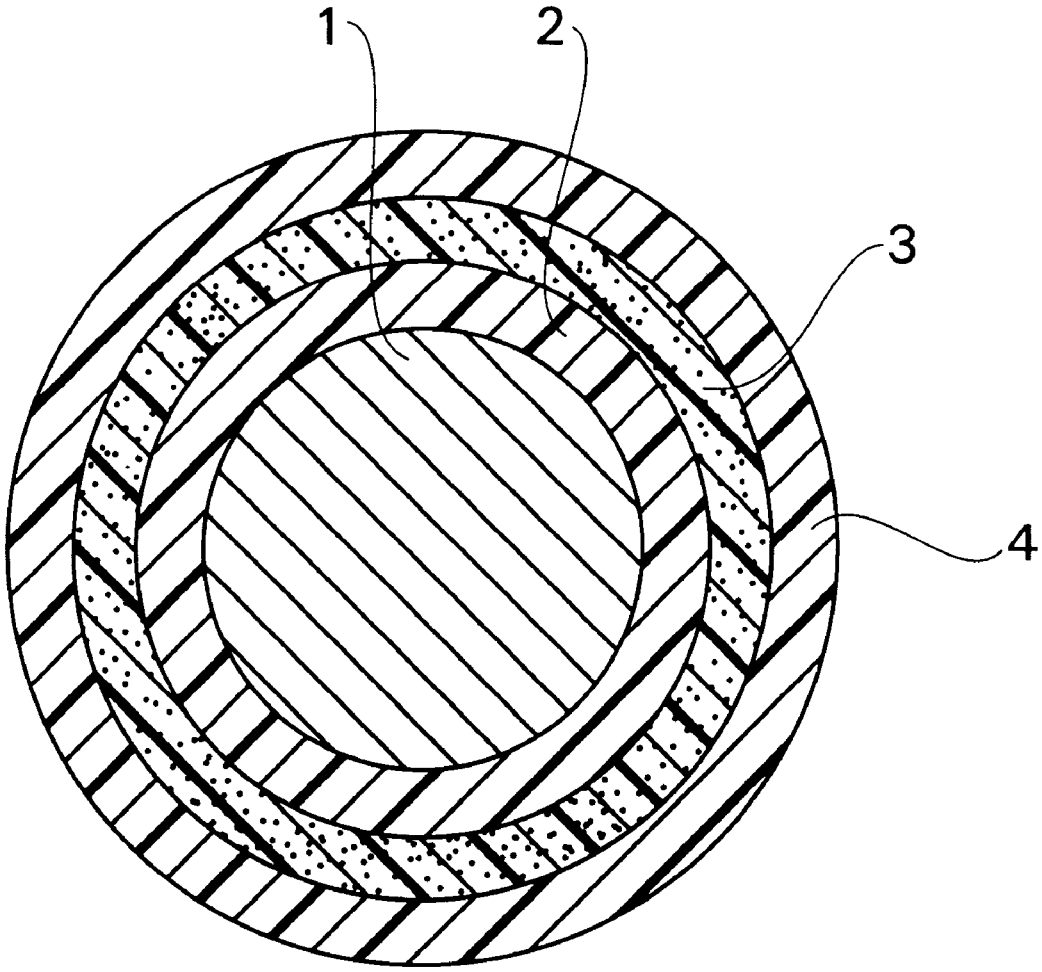
FIG. 1 of the appended drawings is a view in cross-section of an enameled wire in accordance with the invention.
Figure 2:
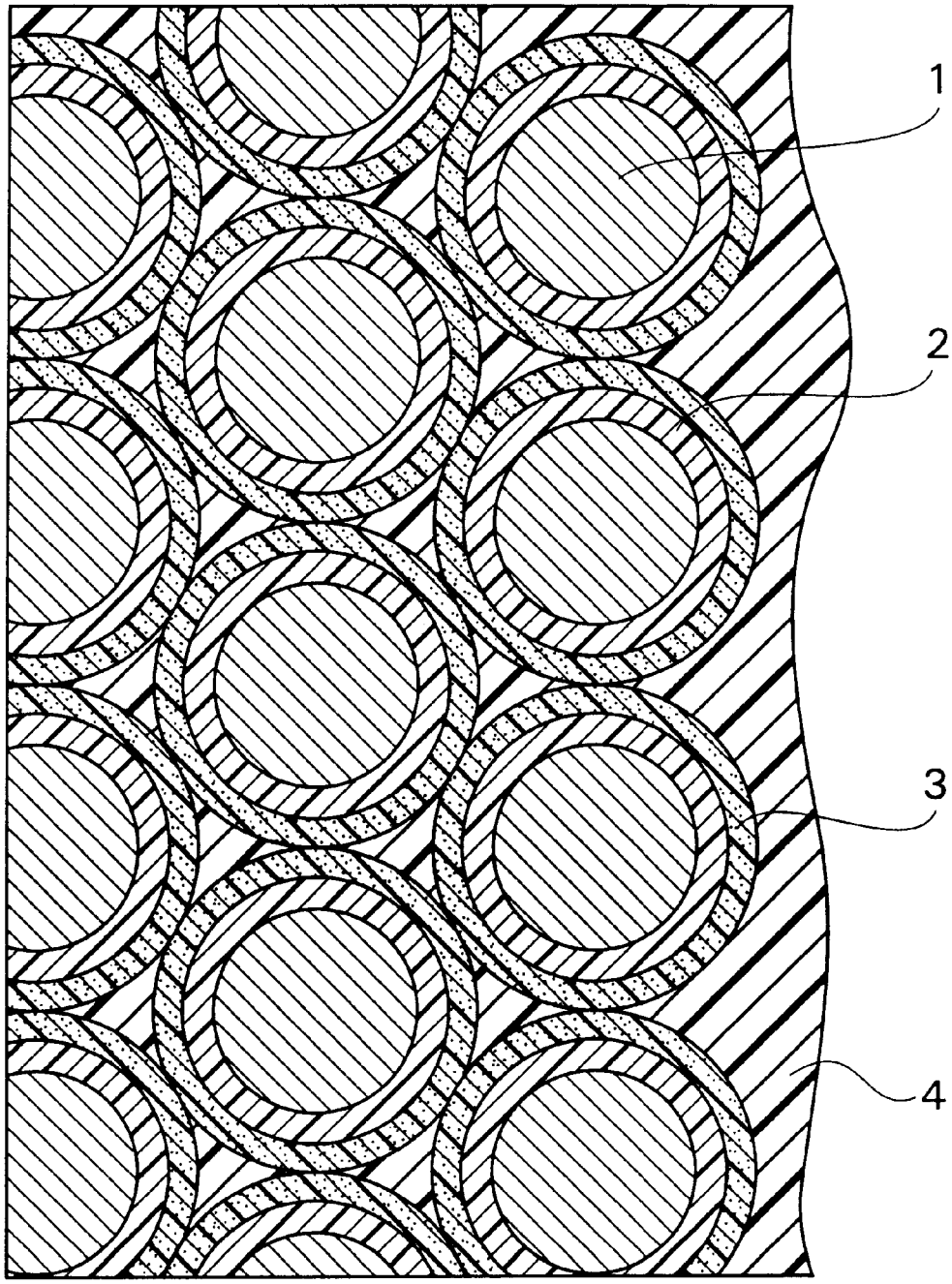
FIG. 2 is a schematic cross section of a winding made from the wire of FIG. 1, and after thermo-bonding.

The wire has a central conductor 1 and successively over the latter a first enamel layer 2, a second enamel layer 3 charged with weakly conductive particles and an exterior thermo-adherent enamel overcoat 4.

The first enamel layer 2 can optionally be charged with weakly conductive particles.

In a variant that is not shown the enameled wire does not include the first enamel layer 2.

An enameled wire of the above kind offers a choice of base resin for the layer 3, resin for the layer 2, if present, and weakly conductive particles dispersed in the resin of the layer 3 and in the layer 2, if present, to obtain the required high corona-resistance of the enameled wire and the required high resistance to partial discharges after winding the wire.

Compared to the enameled wire of the prior art solution mentioned above, the requirement for a virtually smooth surface of the layer 3, which stems in particular from the size of the particles, is no longer imperative because the thermo-adherent overcoat 4 covers it and is perfectly smooth for easy winding. Further, by fusion after winding, this overcoat assures contact between the particles of the layer 3 of turns in contact and fills all air gaps between turns.

Thus the overcoat 4 holds the turns of wound wire in contact with each other very well. It additionally provides excellent external protection of the finished winding.

The initial presence of the outer overcoat 4 on the enameled wire advantageously avoids the need for any subsequent impregnation of the enameled wire for the purpose of winding it, which is generally carried out by the user. This avoids pollution problems due to emanations from solvents because the solvent vapor is treated by the manufacturer but not, as a general rule, by the users constructing the windings. The resin of the overcoat 4 is advantageously a resin applied in the molten state and without any solvent to the wire already carrying its layer 3 and its layer 2, if present. This eliminates emanations from traces of solvents from the overcoat during fusing of the overcoat after winding the wire.

Of course, the enameled wire shown and described hereinabove can have a larger number of layers of resin under the thermo-adherent overcoat 4 without departing from the scope of the invention.

What is claimed is:

1. A winding of enameled wire comprising:

a plurality of contiguous turns formed from an enameled wire, wherein said plurality of contiguous turns are in pressure contact with each other at contacting areas, and are bonded to each other, wherein said enameled wire has a high resistance to partial discharges and includes a smooth surface, said enameled wire further includes an electrical conductor and at least two layers of enamel on said conductor wherein the outermost layer of said layers constitutes an overcoat and is made from thermo-adherent resin defining said smooth surface of said wire, and a directly underlying layer made from a resin charged with weakly conductive particles;

the weakly conductive particles of the directly underlying layer are in contact at said contacting areas between the turns to ensure a homogenous distribution of an electrical field across all the turns, and the outermost layer fills gaps between the turns, bonds the turns to each other and provides an external protection for the winding.

2. The winding of enameled wire as claimed in claim 1 wherein said at least two layers of enamel comprises at least three layers of enamel being on said conductor and wherein the innermost layer is made from resin that is not charged with weakly conductive particles.

3. The winding of enameled wire claimed in claim 1 wherein said outermost thermo-adherent layer of said enameled wire is applied in a molten state and without a solvent.

4. The winding of enameled wire claimed in claim 1, wherein said outermost layer does not contain any weakly conductive particles therein.

5. A winding of enameled wire as comprising:

a plurality of contiguous turns formed from an enameled wire, wherein said plurality of contiguous turns are in pressure contact with each other at contacting areas, and are bonded to each other, wherein said enameled wire has a resistance to partial discharges and includes a smooth surface, said enameled wire further includes an electrical conductor and at least two layers of enamel on said conductor wherein the outermost layer of said layers constitutes an overcoat and is made from thermo-adherent resin defining said smooth surface of said wire, and a directly underlying layer made from a resin charged with weakly conductive particles, the weakly conductive particles of the directly underlying layer are in contact at said contacting areas between the turns to ensure a homogenous distribution of an electrical field across all the turns, the outermost layer fills gaps between the turns, bonds the turns to each other and provides an external protection for the winding, and said at least two layers of enamel comprises at least three layers of enamel being on said conductor and wherein the innermost layer of said layers is also made from resin charged with weakly conductive particles.

6. The winding of enameled wire claimed in claim 5 wherein said outermost thermo-adherent layer of said enameled wire is applied in a molten state and without a solvent.

7. The winding of enameled wire claimed in claim 5, wherein said outermost layer does not contain any weakly conductive particles therein.

* * * * *